US007694353B2

(12) United States Patent
Weston

(10) Patent No.: US 7,694,353 B2
(45) Date of Patent: Apr. 13, 2010

(54) AIR CIRCULATION SYSTEM FOR PROTECTIVE HELMET AND HELMET CONTAINING THE SAME

(76) Inventor: Brian Weston, 1704 Lotug Dr., Orefield, PA (US) 18069

( * ) Notice: Subject to any disclaimer, the term of this patent is extended or adjusted under 35 U.S.C. 154(b) by 1176 days.

(21) Appl. No.: 11/285,178

(22) Filed: Nov. 23, 2005

(65) Prior Publication Data

US 2007/0113318 A1 May 24, 2007

(51) Int. Cl.
*A42C 5/04* (2006.01)
*A42B 1/06* (2006.01)

(52) U.S. Cl. ..... 2/171.3; 2/410

(58) Field of Classification Search ..... 2/171.3, 2/171, 184.5, 410, 411, 414; 34/96, 97, 98, 34/100; 219/222; 128/201.22, 201.23, 201.24, 128/201.25, 201.28
See application file for complete search history.

(56) References Cited

U.S. PATENT DOCUMENTS

| | | | | |
|---|---|---|---|---|
| 2,365,799 | A | 12/1944 | Schwab | |
| 2,437,366 | A * | 3/1948 | Thomas | 34/99 |
| 2,505,378 | A * | 4/1950 | Belgau et al. | 96/144 |
| 3,747,599 | A * | 7/1973 | Malmin | 128/201.12 |
| 4,498,202 | A | 2/1985 | Yamamoto | |
| 4,549,542 | A | 10/1985 | Chien | |
| 4,610,247 | A * | 9/1986 | Stroup | 128/201.28 |
| 4,676,236 | A | 6/1987 | Piorkowski et al. | |
| 4,704,746 | A * | 11/1987 | Nava | 2/424 |
| 5,054,480 | A | 10/1991 | Bare et al. | |
| 5,078,130 | A | 1/1992 | Van Oosten et al. | |
| 5,113,853 | A | 5/1992 | Dickey | |
| 5,245,994 | A | 9/1993 | Chang et al. | |
| 5,283,914 | A | 2/1994 | James | |
| 5,533,500 | A | 7/1996 | Her-Mou | |
| 5,592,936 | A | 1/1997 | Thomas, Jr. et al. | |
| 5,711,033 | A | 1/1998 | Green et al. | |
| 5,758,639 | A | 6/1998 | Ikonen | |

(Continued)

OTHER PUBLICATIONS

ARAI GP-5ac Forced Air Helmet, Dec. 2004, www.saferacer.com/argpfoairhe.html.
ARAI GP-5Kac Forced Air Helmet, Dec. 2004, www.saferacer.com/argpfoairhel.html.

(Continued)

*Primary Examiner*—Gary L Welch
*Assistant Examiner*—Amber R Anderson
(74) *Attorney, Agent, or Firm*—Oliff & Berridge PLC

(57) ABSTRACT

An air circulation system is provided that is fittable to a protective helmet. The system includes an external manifold, a removable intake duct, and a removable exhaust duct. The manifold is mountable to an external surface of a protective shell of a helmet and defines an exhaust passage external of the shell having at least one orifice communicable with an interior crown region of the shell and an intake passage communicable with a bottom region of the shell near a wearer's mouth and nose. The removable intake duct is connected to a remote positive pressure source at one end and connected to the external intake passage on the other end. The removable exhaust duct is connected to a remote source of negative pressure at one end and connected to the external exhaust passage of the external manifold on the other end. Fresh air can be circulated to the bottom region by the positive pressure source and exhaust air can be forcefully removed from the crown region by the negative pressure source to provide a complementary air circulation system for the wearer of the helmet.

20 Claims, 11 Drawing Sheets

U.S. PATENT DOCUMENTS

| | | | | |
|---|---|---|---|---|
| 5,794,260 | A | 8/1998 | Schegerin | |
| 5,887,281 | A | 3/1999 | Green et al. | |
| 5,921,467 | A | 7/1999 | Larson | |
| 6,081,929 | A | 7/2000 | Rothrock et al. | |
| 6,250,299 | B1 | 6/2001 | Danisch et al. | |
| 6,293,030 | B1 * | 9/2001 | McCurtis et al. | 34/96 |
| 6,382,208 | B2 | 5/2002 | Reedy et al. | |
| D492,817 | S | 7/2004 | Simpson | |
| 6,766,537 | B1 | 7/2004 | Maki et al. | |
| D498,883 | S | 11/2004 | Simpson | |
| 6,973,676 | B1 * | 12/2005 | Simpson | 2/171.3 |
| 2003/0192537 | A1 | 10/2003 | Odell et al. | |

OTHER PUBLICATIONS

SIMPSON SIDEPRO SHARK, Dec. 2004, www.simpsonraceproducts.com.

SIMPSON F/C Shark Helmet, Dec. 2004, www.simpsonraceproducts.com.

SPARCO Fl Helmet, Dec. 2004, www.racehelmet.com/sparco/sparco4.html.

Bell M2 Forced Air Helmet, Dec. 2004, www.randys-racemart.com/belForairhel.html.

Fresh Air Systems Technologies Inc. Online Catalog, Dec. 2004, pp. 1-11. http://members.tripod.com/-DED_3/RAFFO.html.

"2000 Standard for Protective Headgear," Snell Memorial Foundation, 2000, pp. 1-34.

* cited by examiner

AIR CIRCULATION SYSTEM FOR PROTECTIVE HELMET AND HELMET CONTAINING THE SAME

BACKGROUND

This invention relates to a forced air circulation system for a protective helmet. The circulation system provides incoming air to a bottom region of the protective helmet and actively extracts exhaust air from a crown region of the helmet. This invention also relates to a protective helmet incorporating a forced air circulation system.

Protective safety helmets are worn in many recreational and racing activities. These include protective helmets for motorcycles, snowmobiles, and automobile racing. Helmets for these activities must typically conform to various safety standards set by the Dept. of Transportation (DOT) and the SNELL Memorial Foundation, for example. These standards include stringent impact protection, visibility, and, for certain applications, fire resistance requirements. For motorcycle use, the current SNELL standard is M2005. For automotive racing applications, the current standard is SA2005.

Full face models of these protective helmets include a full chin piece and visor and are designed to be substantially airtight. As a result, air circulation through the helmets can be problematic. When used in free-flowing environments, such as when riding a motorcycle, there may be sufficient airflow into the helmet. However, when used in substantially closed or dirty environments, it would be advantageous to provide a fresh supply of breathing air to the helmet interior.

Many helmets have been developed in attempts to solve this problem. However, current designs typically suffer from one or more problems.

SUMMARY

Several recent automotive racing helmets have been developed to provide filtered, and sometimes cooled, air to a helmet wearer. These typically include a side inlet port that communicates with the helmet interior. Examples of these include the Arai GP-5Kac, Arai GP-5ac, Simpson Shark Sidewinder, and Bell Vortex Forced Air helmets. The inlet port is connectable through a detachable hose to a remote positive pressure air source, such as AC or DC-powered blowers marketed by Fresh Air Systems Technologies (F.A.S.T.).

Although these helmets can provide filtered air into the helmet, they do not always result in good circulation through or out of the helmet. For example, if the helmet is substantially airtight, it is difficult for exhaled gases to be removed from the helmet. As a result, backpressure or restrictions prevent a consistent supply of fresh air to the wearer, resulting in either too much air and pressure, or not enough. In such designs, gases typically passively exit through minor openings, such as those existing around the wearer's neck at the interface between the helmet liner and the neck and/or around the visor. This results in an uncontrolled supply of air and does not assist in venting of hot air from inside of the helmet, particularly in the crown region.

Other known protective helmets have provided filtered air to an interior of a helmet through a port located on top of the helmet. These include, for example, U.S. Pat. No. 5,533,500 to Her-Mou, U.S. Pat. No. 6,766,537 to Maki et al., U.S. Pat. No. D498,883 to Simpson (corresponding to Impact Racing's Super Charger Air Induction Helmet), and U.S. Pat. No. D492,817 to Simpson (corresponding to Inpact Racing's Air Vapor Racing Helmet). However, these designs also suffer from uncontrolled or poor circulation because they only provide incoming air and rely on passive exhausting of air. Because of the unknown and uncontrollable restrictions caused by the passive exhausting, there is an uncontrolled supply of air. Also, in these systems incoming air is passed over an often hot and sweaty wearer's head before reaching the nose and mouth. As a result, breathing air that may be received by the wearer may not be fresh.

Several known motorcycle and automotive helmets have been modified to add passive ports at various locations around the helmet, including around the crown region of the shell to provide passive cooling or venting. Examples of these include the Arai GP-5Kac, Arai, RX-7 Corsair, and Simpson Sideshark Pro. However, because SNELL requirements limit any opening through the protective shell to less than 13 mm, the amount of air circulation from passive venting is severely restricted.

A few protective helmet designs have incorporated built-in fans within the interior of the helmet to assist in venting of air or entry of air. These include U.S. Pat. No. 6,081,929 to Rothrock et al. and assigned to Bell Sports and U.S. Pat. No. 5,113,853 to Dickey. These fans, however, cause several problems with the protective helmet. They typically will result in a helmet that is heavier and/or has a higher center of gravity. Moreover, provisions for the internal fan make it necessary to use an undersized fan to keep weight and overall size down in order to attain desirable impact resistance and other stringent standards requirements. Minimizing of the size of the fan to address some of these issues has the adverse effect of providing insufficient circulation.

Another potential problem exists with protective safety helmets used in automobile racing. Recent advances in protective devices have incorporated various head and neck restraint systems, such as the HANS device, to helmets. These restraint systems detachably couple the helmet to the restraint system, which is secured to the wearer's body or to the vehicle to minimize head and neck movement in an impact. Although a good safety feature when used by itself, it is sometimes difficult to use such restraint devices on a helmet having a conventional side port mounted forced air intake system. Additionally, as more padding is added to the seat to support the driver's head, it becomes more difficult to use side forced air ports. This is because the side connection port or tubing may interfere with the restraint system and/or additional side padding of the driver's seat, preventing or inhibiting quick coupling of the hose, and possibly limiting head movement. As a result, use of both the neck restraint and forced air systems may be cumbersome to a driver.

There is a need for an improved forced air circulation system for a protective helmet, particularly for a protective helmet useful for automotive racing applications.

There also is a need for a forced air circulation system that can be readily retrofitted to a standard full face helmet with minimal modifications to the helmet.

Additionally, there is a need for a forced air circulation system that can provide a balanced flow and circulation of fresh and exhausted air to and from a helmet interior. In particular, there is a need for a forced air circulation system that provides fresh breathing air to a mouth region of a helmet interior while also actively extracting exhaust air from a crown region of the helmet interior. This ensures a controlled supply of fresh air to the wearer of the helmet and also provides a benefit of cooling the wearer's head.

There further is a need for a forced air circulation system that is lightweight and has minimal impact on the wearer's head mobility.

There also is a need for a forced air circulation system that can be quickly and readily coupled to and decoupled from a helmet. In a preferred embodiment, this coupling takes place through a single connection port for both intake and exhaust of air. In a most preferred embodiment, this single connection port is provided on top of the helmet, so as to be readily accessible and out of the way of the seat, seat padding and any restraint system used in the various forms of automotive racing.

In various exemplary embodiments, an air circulation system is provided that is fittable to a protective helmet. The system includes an external manifold, a removable intake duct, and a removable exhaust duct. The exhaust duct is mountable to an external surface of a protective shell of a helmet, the external manifold defining an exhaust passage external of the shell having at least one orifice communicable with an interior crown region of the shell and an intake passage mountable to a bottom region of the shell. The removable intake duct is connected to a positive pressure source at one end and connected to the external intake passage on the other end. The removable exhaust duct is connected to a source of negative pressure at one end and connected to the external exhaust passage of the external manifold on the other end. Fresh air can be circulated to the bottom region by the positive pressure source and exhaust air can be forcefully removed from the crown region by the negative pressure source to provide a complementary air circulation system for the wearer of the helmet.

In accordance with other aspects, a protective helmet is provided that incorporates a forced air circulation system. The helmet includes a protective shell having an interior and exterior surface, the interior surface defining an interior crown region sized to fit a wearer's head and a mouth region air space in close proximity with a wearer's mouth. An external manifold is mounted to the external surface of the protective shell, the external manifold defining an exhaust passage external of the shell and in fluid communication with the interior crown region of the shell and an intake passage external of the shell and directed to the mouth region of the shell. A removable intake duct is connectable to a positive pressure source at one end and connected to the external intake passage on the other end. A removable exhaust duct is connectable to a source of negative pressure at one end and connected to the external exhaust passage of the external manifold on the other end. Fresh air is circulated to the mouth region by the positive pressure source and exhaust air is forcefully removed from the crown region by the negative pressure source to provide a complementary air circulation system for the wearer of the helmet.

BRIEF DESCRIPTION OF THE DRAWINGS

The invention will be described with reference to the following drawings wherein like numerals refer to like elements, in which.

DETAILED DESCRIPTION OF EMBODIMENTS

A first embodiment of a forced air circulation system 100 useable with a protective helmet 200 will be described with reference to FIGS. 1-15. The forced air circulation system 100 may be incorporated into a specialized protective helmet 200 or, in a more preferred embodiment, is a standalone system that can be installed on or retrofit for use with a conventional protective helmet. This latter ability allows the system to be adapted to use with a user's existing helmet with minimal modification. This also allows the system to be readily removed to restore original functionality to the helmet without forced air circulation.

Figure 1:
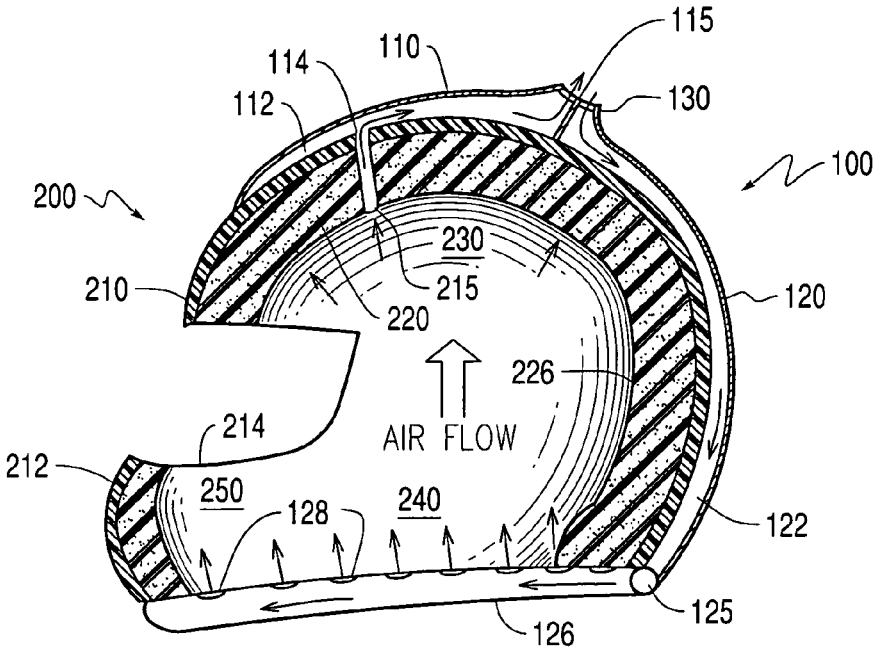
FIG. 1 is a cross-sectional view of an exemplary protective helmet and forced air circulation system taken along a helmet centerline.
Figure 2:
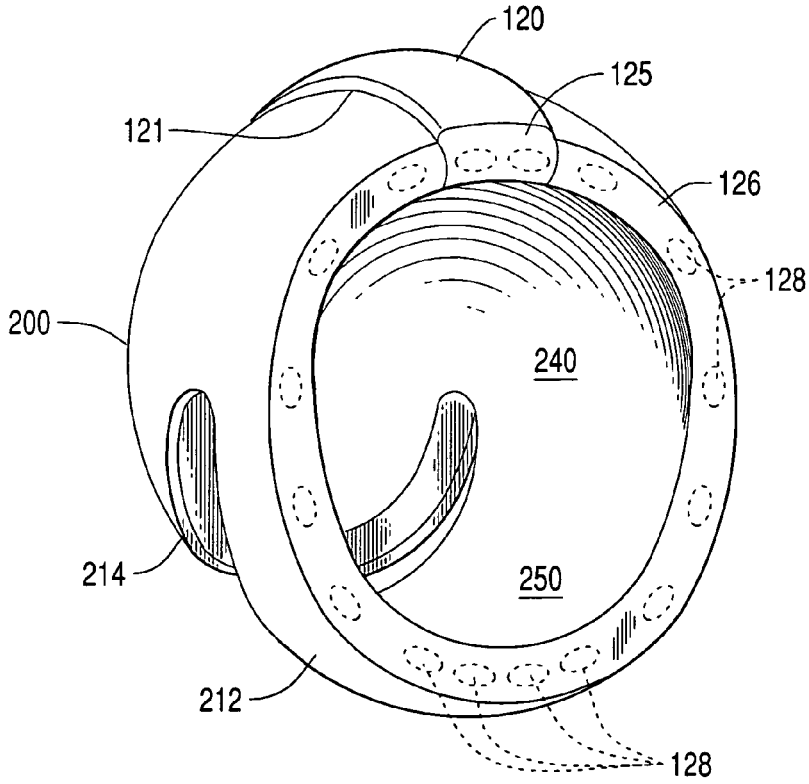
FIG. 2 is a bottom perspective view of the helmet and forced air circulation system of FIG. 1.

As best shown in FIGS. 1-2, helmet 200 in a preferred embodiment is a full face helmet having an impact resistant outer shell 210 and an inner impact liner, both made of suitable conventional materials and construction as known in the art to enable the helmet to meet current safety standards, such as SNELL M2005 or SA2005. Shell 210 includes a main body portion covering the head of a wearer, a chin bar portion 212 covering a mouth of the wearer, and an open eye port portion 214 that receives a visor (unshown). The interior of the impact liner 220 defines a crown region 230 that receives the wearer's head and a bottom region 250 that provides a breathing area for the wearer near a wearer's mouth. An interior liner 226 covers the impact liner 220 and is also of conventional materials, such as nylon for motorcycle applications or fire retardant Nomex for automotive applications. Liner 226 may also include a neck roll around a perimeter of base opening 240. The neck roll is preferably closely fitted to rest against a wearer's neck.

Helmet-mounted portions of the forced air circulation system 100 include an external exhaust manifold assembly 110, intake assembly 120, and common connection port 130. These portions can be fabricated from a suitable material, such as plastic or carbon fiber by vacuum forming or injection molding. Preferably the helmet-mounted portions are light and rigid to minimize helmet weight and improve functionality. Connection port 130 in this embodiment is common to both the intake and exhaust and is connectable to a positive air source and an active exhaust source through a removable air circulation hose 140 (FIGS. 7-8) that contains two separate flow ducts (one for intake and one for exhaust) as will be described later in more detail.

Figure 3:
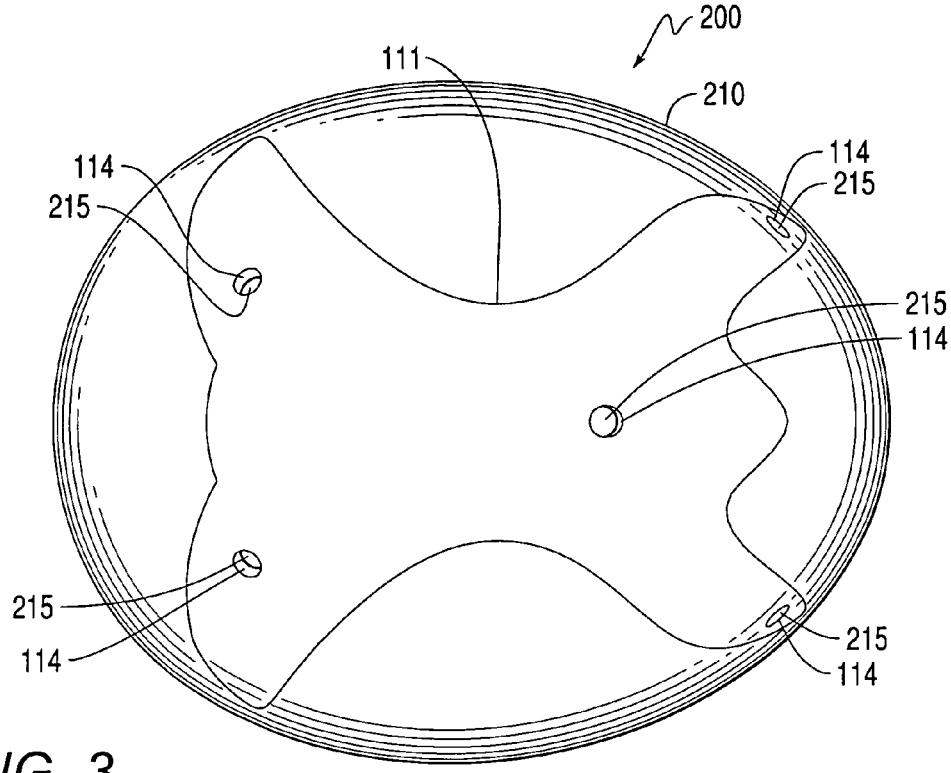
FIG. 3 is a top view of a protective helmet showing an exemplary layout of existing air circulation holes provided through the helmet shell that communicate with an external manifold of the forced air circulation system (only the periphery of the external manifold is shown for clarity)
Figure 4:
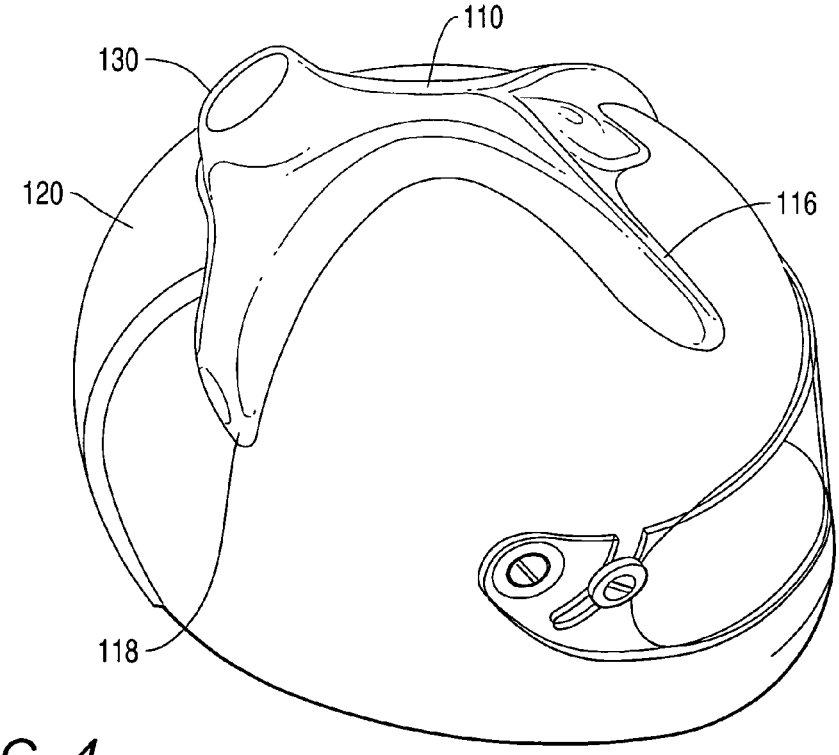
FIG. 4 is a side view of the helmet of FIG. 3 with the external manifold mounted.
Figure 5:
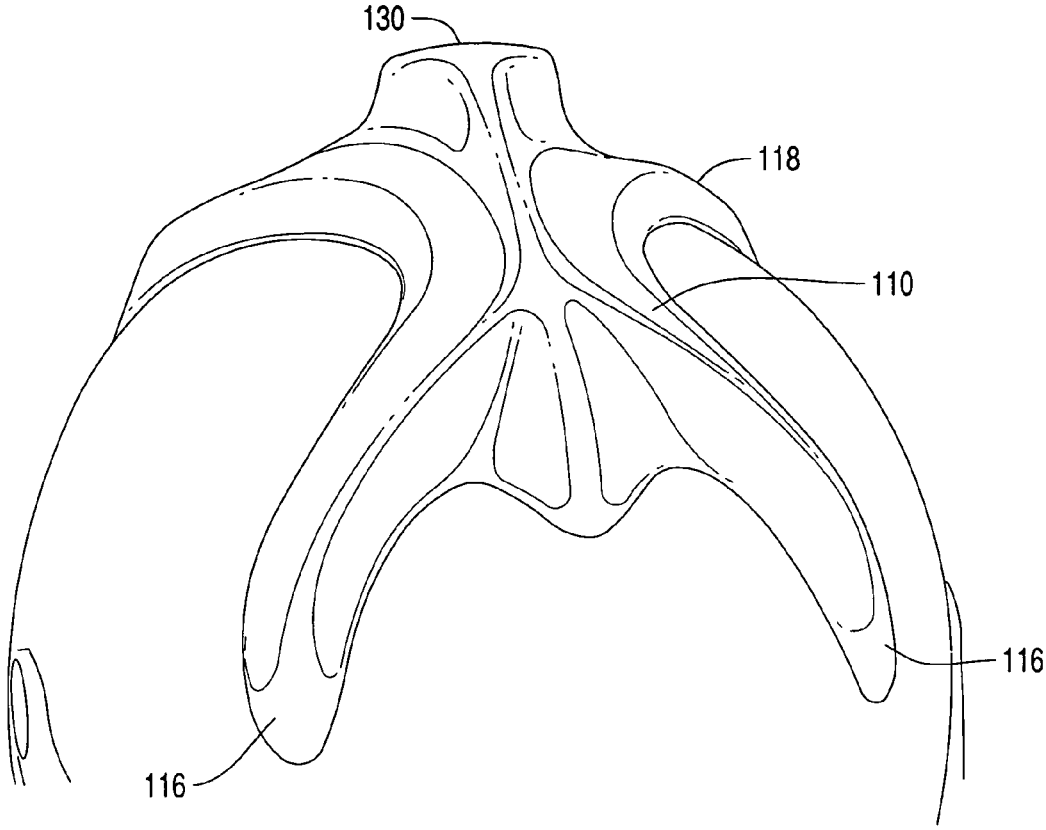
FIG. 5 is a top right front perspective view of the helmet of FIG. 4.
Figure 6:
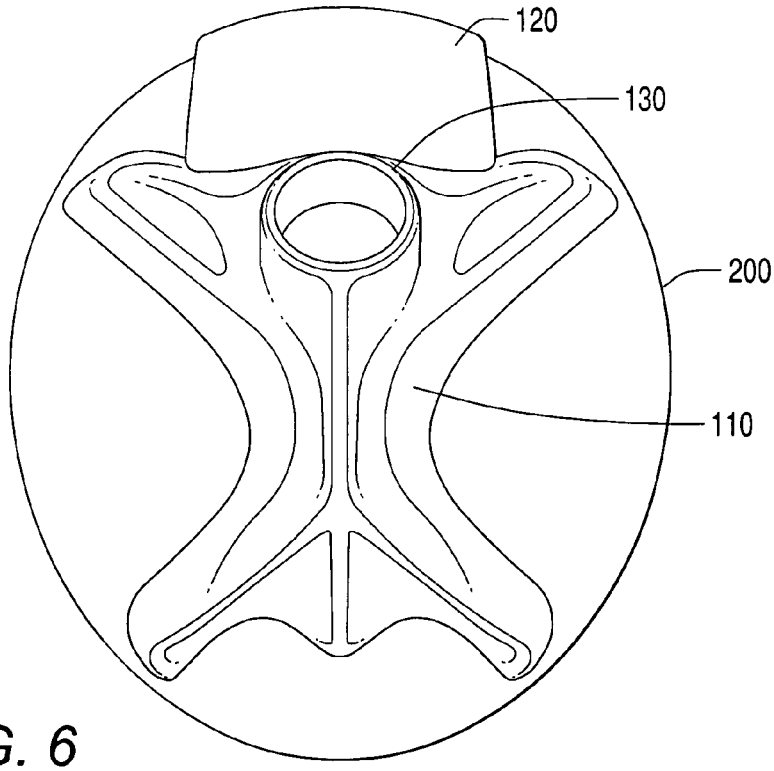
FIG. 6 is a top view of the helmet of FIG. 4.
Figure 7:
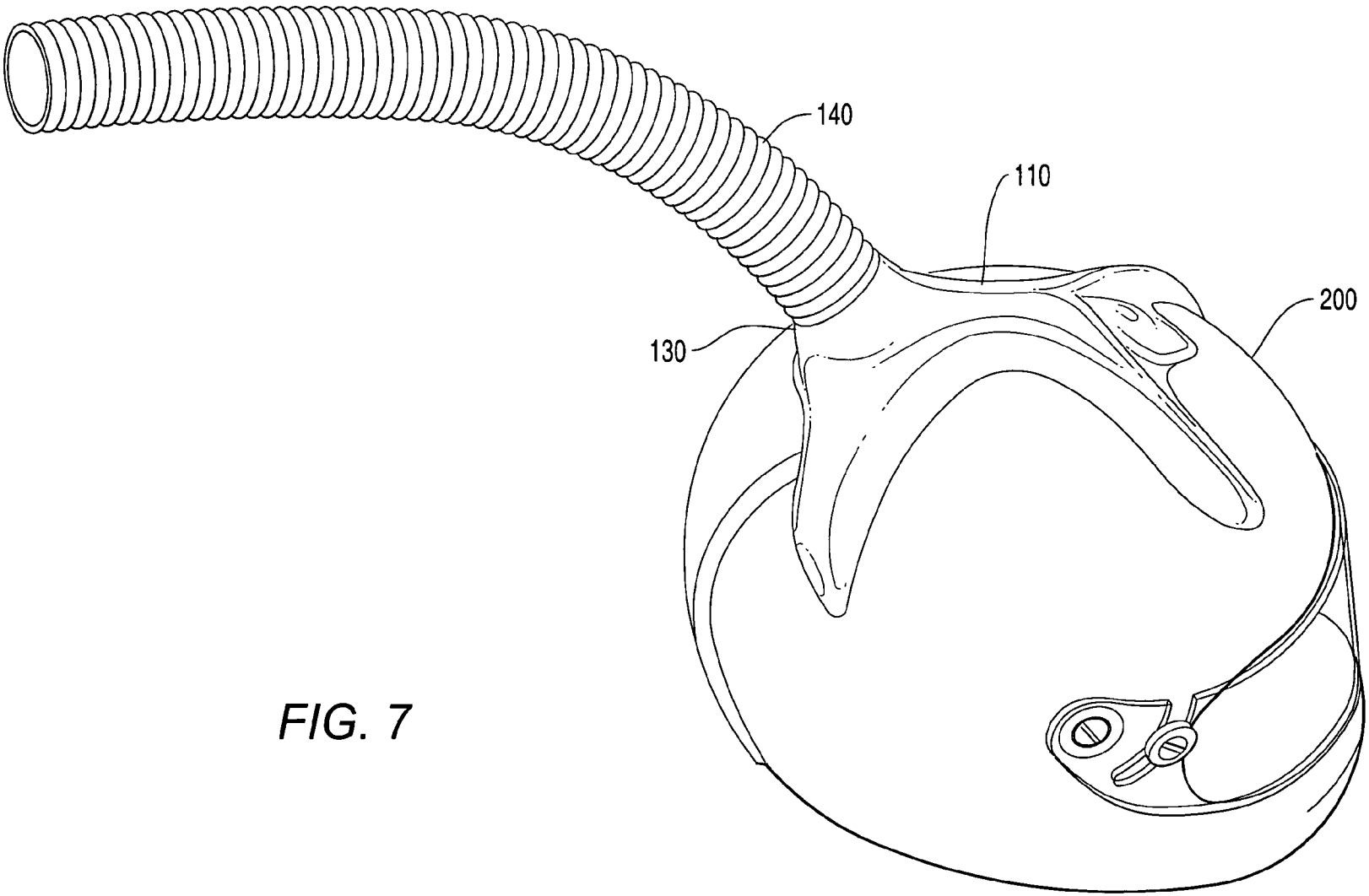
FIG. 7 is a side perspective view of the helmet of FIG. 4 connected to a removable circulation duct at a single connection port located on a top of the helmet.

Manifold assembly 110 provides at least one and preferably a plurality of exhaust passages 112 externally provided around the helmet perimeter. In a preferred embodiment, manifold 110 includes an outer wall defining a central portion, two forward extending fingers 116 and two rearward extending fingers 118 (FIGS. 4-6) and a bottom wall 111 (FIG. 3) that define passages 112 between the outer and bottom walls. Each finger passage may be provided with one or more openings 114 in the bottom wall 111 that align with corresponding apertures 215 in shell 210 of the helmet (FIG. 3). Also, one or more openings 114 may be provided in a central passage. Apertures 215 preferably extend through both shell 210 and impact liner 220 as shown in FIG. 1 to form a fluid communication path from crown region 230 of the helmet interior to the manifold assembly 110.

Because stringent SNELL helmet impact requirements limit holes in the helmet shell to about 13 mm, circulation through the helmet is increased by use of a helmet having a plurality of pre-existing apertures 215, such as the exemplary five 7.8 mm diameter apertures 215 shown. It should be clear that this system can be adjusted and customized to work with existing holes in a different layout as provided by the particular helmet model or manufacturer. However, more holes will allow for more performance and enable exhausting of air in a quantity proportionate to the amount of incoming air entering the helmet interior to provide a controlled circulation of fresh air to the helmet. Moreover, by spacing the holes around the helmet shell 210 as shown, cooling through air circulation can be achieved throughout the helmet interior.

Figure 8:
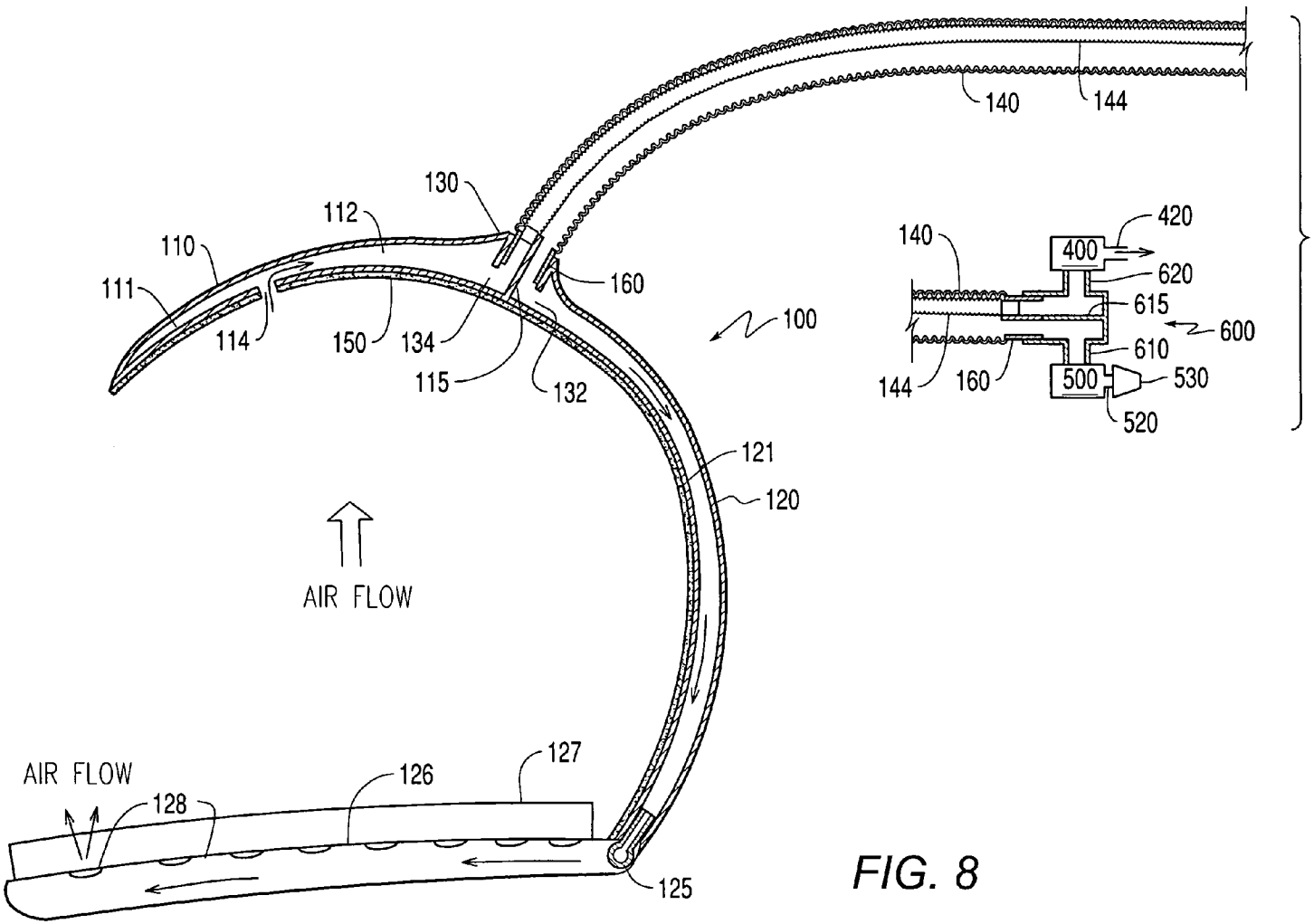
FIG. 8 is a side cross-sectional view of the forced air circulation system of FIG. 1.

Intake assembly 120 routes incoming air received from a remote positive pressure air source and channels the incoming air around the helmet exterior to a bottom region 250. In an exemplary embodiment, this is achieved by a main intake passage 122 being formed between an outer wall of the intake assembly 120 and a bottom wall 121 (FIG. 8). Passage 122 extends down the rear of the helmet 200 to the base where an intake coupler 125 couples the main passage 122 with an intake ring 126 that extends around at least a portion of the helmet's lower perimeter as best shown in FIGS. 1-2. Intake ring 126 is provided with one or more openings 128 that communicate with at least a front portion of the bottom region 250 of the helmet to provide a source of fresh air to the wearer's mouth and nose. However, it may be desirable, as shown, to provide openings 128 around a majority of the perimeter of the helmet to improve circulation to the helmet interior. To ensure sufficient air for breathing, openings 128 near the front of bottom region 250 may be enlarged relative to other openings. To minimize the height of the intake assembly, it is preferably wide and shallow as shown. A suitable exemplary size is ¼" H×4" W.

Thus, as shown in FIG. 1, incoming air from port 130 is directed around the helmet 200 into the bottom region 250, where it passes upwards into crown region 230 and is actively exhausted through apertures 215 and corresponding openings 114 into exhaust manifold 110 and exited through connection port 130 outside of the helmet. This allows for a controlled and balanced flow of fresh air into the helmet and stale, hot air out of the helmet.

A complete retrofittable forced air circulation system will be described with respect to FIGS. 8-11. This system is capable of installation on most any conventional safety helmet having pre-existing helmet vent holes that can mate with the corresponding openings 114 of the manifold 110. For example, current Arai helmets, such as the RX-7 Corsair, already have preexisting vent holes and a passive manifold. All that is required for retrofit is the removal of the passive manifold and substitution with exhaust manifold 110 and appropriately located openings 114.

Although it is possible for exhaust manifold 100 and intake assembly 120 to be made integral, it may be advantageous for manufacturing, installation or replacement purposes for the components to be separate combinable pieces. It may also be advantageous for the coupler 125 and intake ring 126 to be separate. For example, in order to adapt to different sized helmets ranging from XS to XXL, there may be several different lengths or curvatures of intake 120, intake ring 126, and exhaust manifold 110 size. These may be specific to each helmet size, or may be interchangeable to adapt the system to a different helmet size. It may also be possible to standardize one or more of the pieces for use with several helmet sizes.

In any case, exhaust manifold assembly 110 and intake assembly 120 include a suitable helmet fastener 150, such as an adhesive layer as shown, to securely mount or affix the assembly to the helmet shell 210 in a fixed or removable manner. A suitable adhesive is commercially available double-sided foam adhesive tape. However, other fasteners, such as use of bonding, rivets, snaps, Velcro, etc. can be used to mount or affix the assembly onto the helmet shell exterior. Intake ring 126 can be similarly mounted securely to the rim of the helmet by a suitable fastener 127 such as Velcro, snaps, etc. Fastener 127 could also be an adhesive, or more preferably is a strip of lining material that attaches to ring 126 and can be tucked between the helmet's inner liner 220 and shell to secure the ring 126 in place. By use of removable fasteners 150, 127, the entire assembly 100 can be removably fitted to a helmet without destroying the integrity of the helmet, enabling selective use of the air circulation system with the helmet.

Figure 9:
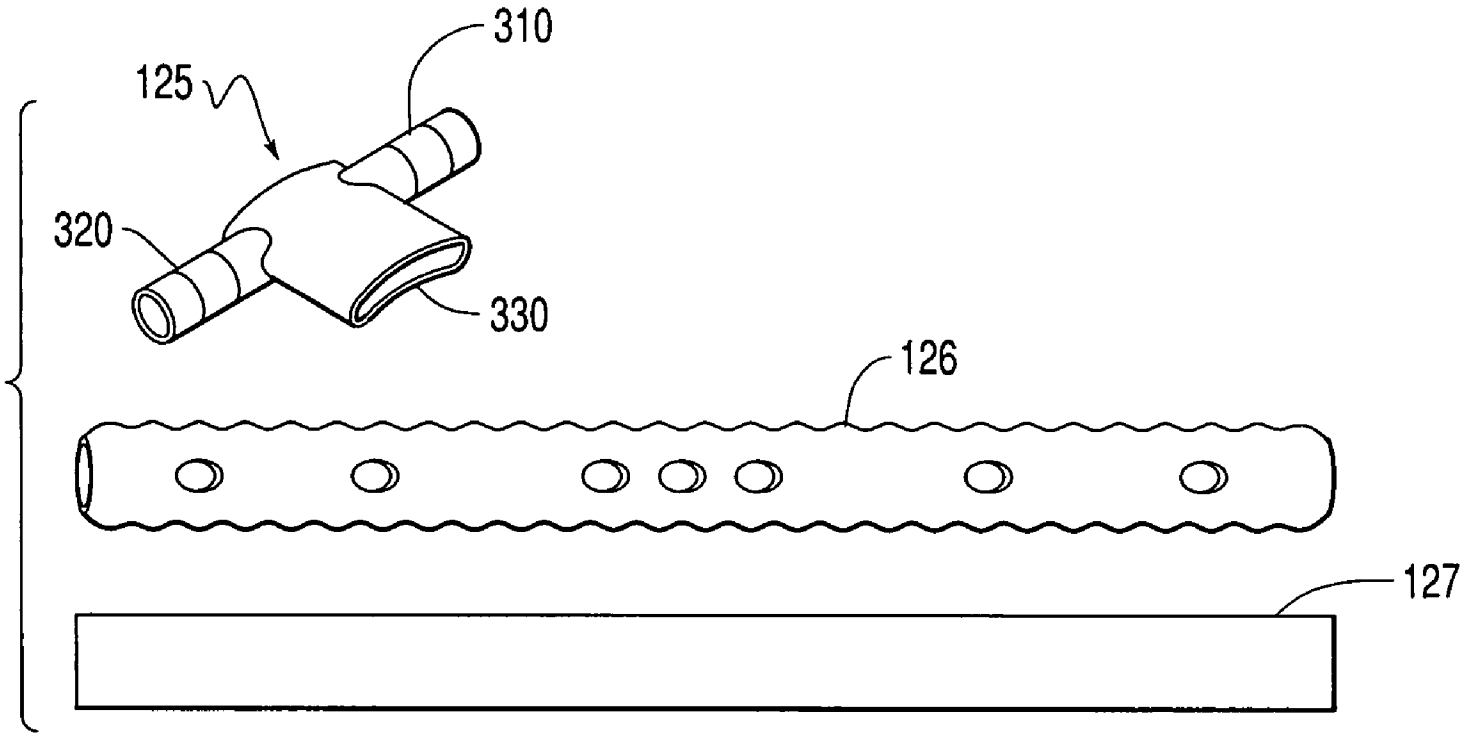
FIG. 9 is an exemplary view of a lower intake manifold assembly formed by an intake coupler, and intake ring with fresh air ports, and an attachment device.

As shown in FIG. 9, coupler 125 preferably includes an intake opening 330 that is sized to mate with the intake assembly 120 and two circular outlets 310, 320 that mate with tubular intake ring 126. Outlets 310, 320 may include annular protrusions to assist in securing of the ring to the coupler. Ring 126 is preferably formed from a flexible material that will readily conform to the perimeter of the helmet base and will not cause injury to the wearer's neck from use or as a result of an impact. Rather, a preferred material should be crushable should the helmet be urged sideways to contact the wearer's neck or shoulders or forward to contact wearer's chest. A suitable material is flexible plastic hose.

Figure 10:
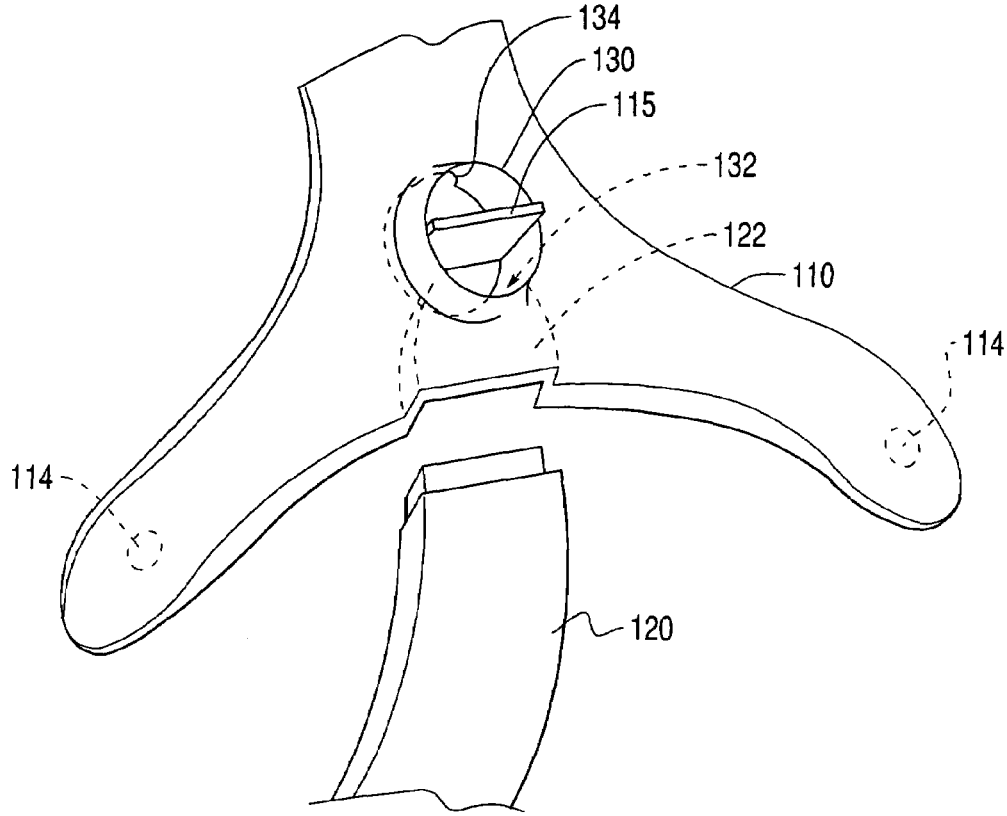
FIG. 10 is an exploded partial view of an external manifold assembly according to a first embodiment.

As best shown in FIG. 10, connection port 130 is preferably round and separates into an incoming flow path that communicates with the passage inside intake assembly 120 through chamber opening 132 and an outgoing flow path that communicates with the passages in the exhaust manifold assembly 110 through chamber opening 134. The two flow paths are maintained separated by a divider wall 115 provided as either part of connection port 130 as shown or part of fitting 160 of connection hose 140.

Figure 11:
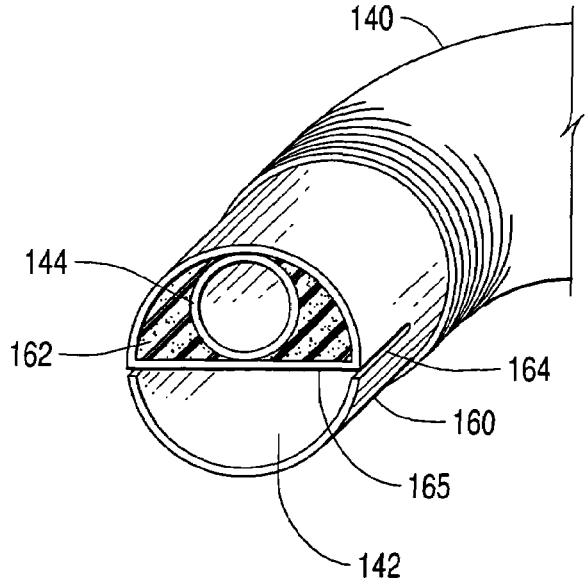
FIG. 11 is a partial perspective view of an exemplary air circulation duct and fitting used with the assembly of FIG. 10.

As shown in FIG. 11, fitting 160 is sized and shaped to securely couple to the connection port 130 through friction fit, snap fit or other conventional coupling mechanisms. When securely coupled, divider wall 165 should seal off the two flow paths. To enable correct orientation of the fitting, fitting 160 may be provided with a keying feature 164 that mates with a corresponding feature 136 on the connection port 130. The keying feature may be a separate notch and corresponding protrusion, or may be the divider wall 165 and a pair of notches if the wall is off-center so that the fitting can be assembled in only one orientation that properly aligns an exhaust duct of the connection hose 140 with the exhaust chamber in the connection port 130.

Connection hose 140 is this exemplary embodiment is capable of providing two separate flow paths 142, 144 by providing a smaller hose within a larger hose. The smaller hose is sealingly fitted to fitting 160 so that when fitting 160 is secured to connection port 130, flow path 144 is sealed from flow path 142. This may be achieved through use of a rubber, foam or other sealant 162 being applied around the end of the smaller hose as shown in FIG. 10 for mating with divider wall 165. Any suitable material may be used for the connection hoses. However, it is desirable for the hose to be flexible and resistant to collapse or bulging from the active exhaust source 400 or the positive air supply source 500. A preferred material for the outer hose is flexible plastic hose. A suitable material for the inner hose is flexible plastic hose. Both flow paths should be suitably sized to flow a desired volume of air. An exemplary hose uses a ½" diameter inner hose and a 2" diameter outer hose. However, volumetrics for the particular helmet and manifold geometries may dictate use of different sizes to achieve a desirable flow balance.

For simplicity and interchangeability, both ends of connection hose 140 may have the same fittings 160. The second end of hose 140 would thus similarly mate with a connection port 600 remote from the helmet that connects the connection hose 140 to a source of positive breathable gas or air 500 through chamber 610 and a source of active exhaust source 400 through chamber 620 (FIG. 8). Source 500 may be a conventional AC or DC powered blower or fan unit that can force air into the helmet. A suitable source 500 would be the powered blowers marketed by F.A.S.T. under the product numbers RA120, RA121, RA122, RA123, and RA124. These draw air through an intake 520 that may include a filter 530. However, other blowers, such as those found in vacuum cleaners, hair dryers, etc. can be adapted for use with this invention. The level or volume of air flow is not limited and can be tailored to the individual needs of the driver, or restrictions of either the available air system and/or power source. A suitable active exhaust source 400 could be of the same type as the intake, only run in reverse or connected to the opposite end of the source and including an exhaust 420 that vents to atmosphere. Alternatively, the active exhaust source 400 could be a non-powered source of negative pressure, such as a NACA duct positioned to receive negative atmospheric pressure rather than ambient. When used in a closed cockpit vehicle, this may be located on the exterior side of the rear window, or in other vehicles may be on an external side of a rear bumper or spoiler. Both power sources 400, 500 may be securely mounted remote from the wearer, such as attached to a vehicle in which the wearer is riding. Various cooling devices may be additionally provided to cool the incoming air.

In preferred embodiments, the sources 400, 500 should complement each other so that the circulation of air is controlled and balanced. That is, the amount of air exhausted out of the helmet should be substantially equal to the amount of air being forced into the helmet. This provides a constant source of fresh air for the wearer. It should not result in drying out of the eyes or breathing difficulties from extracting too much air and should not result in extreme positive pressures from not drawing out enough air. Proper balance will also act to prevent fogging of the visor due to the proper circulation of air from the mouth area 250 over the visor area to the crown region 230.

Flow balance can be achieved through proper selection of motor, motor speed and fan size, as well as the number and size of openings in the helmet and connection hose size. Also, rather than use of two separate powered sources, one for the intake and one for the exhaust, it may be possible to provide a single motor that drives an axial shaft with two oppositely driven fan blades, one providing the positive pressure and the other the negative pressure. Because both fan blades are driven by the same motor, a more balanced flow should be possible with less control. One suitable source of this type is illustrated in U.S. Pat. No. 4,549,452 to Chien, the subject matter of which is hereby incorporated herein by reference in its entirety.

An alternative connection port and connection hose are described with reference to FIGS. 12-15. In these examples, connection hose 140 consists of two coaxial hoses, a larger hose 142 and a coaxially arranged smaller tube 144 that are both provided within fitting 160. These form separate removable intake and exhaust ducts for the air circulation system 100. Corresponding connection port 130 is similarly provided with a large circular opening and a smaller concentric opening formed by extending wall 136 best shown in FIGS. 14-15. In these examples, wall 136 is L-shaped and defines a flow path that exits the connection port 130 at opening 134 in fluid communication with the exhaust passages of exhaust manifold 110. The outer annular opening defined between outer walls of port 130 and wall 136 lead to opening 132 in fluid communication with the passage in intake assembly 120.

Figure 12:
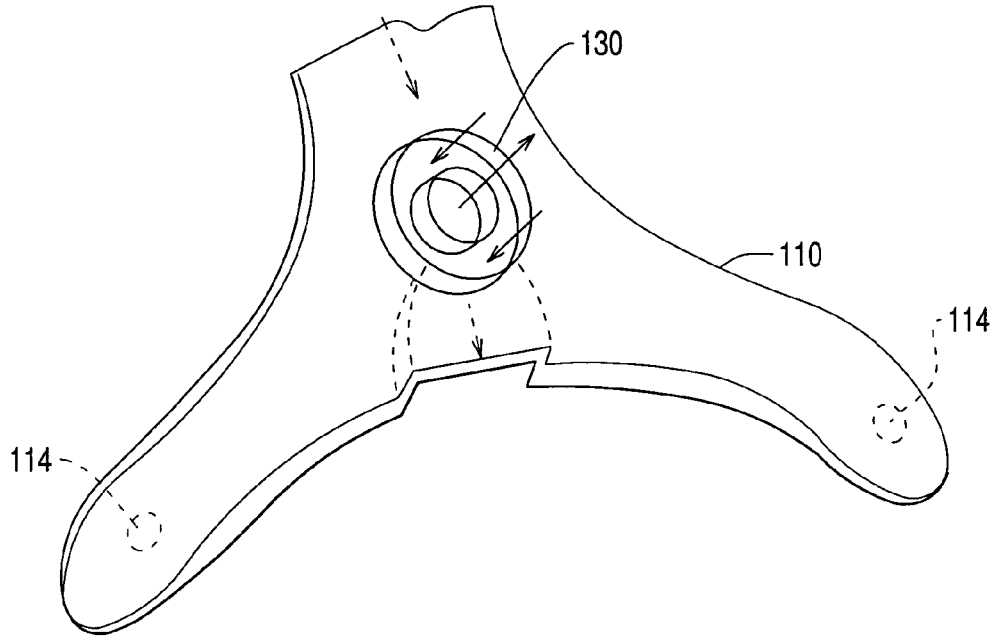
FIG. 12 is an exploded partial view of an external manifold assembly according to a second embodiment.
Figure 13:
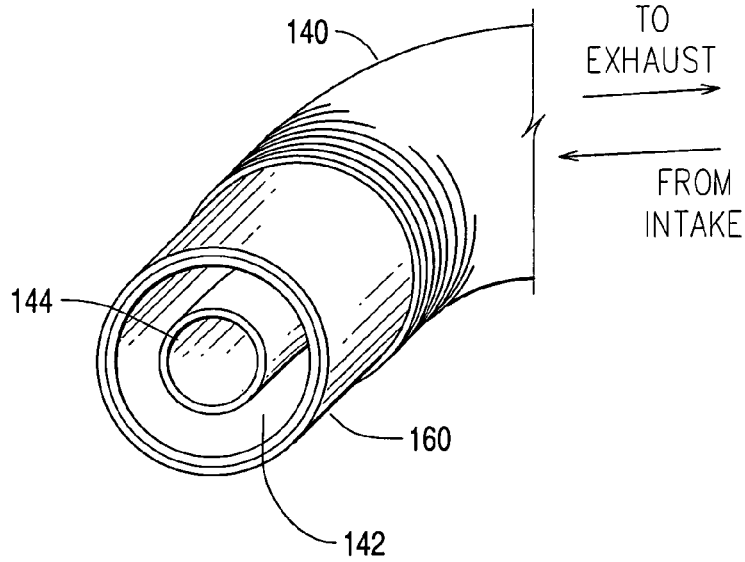
FIG. 13 is a partial perspective view of an exemplary air circulation duct and fitting for use with the assembly of FIG. 12.
Figure 14:
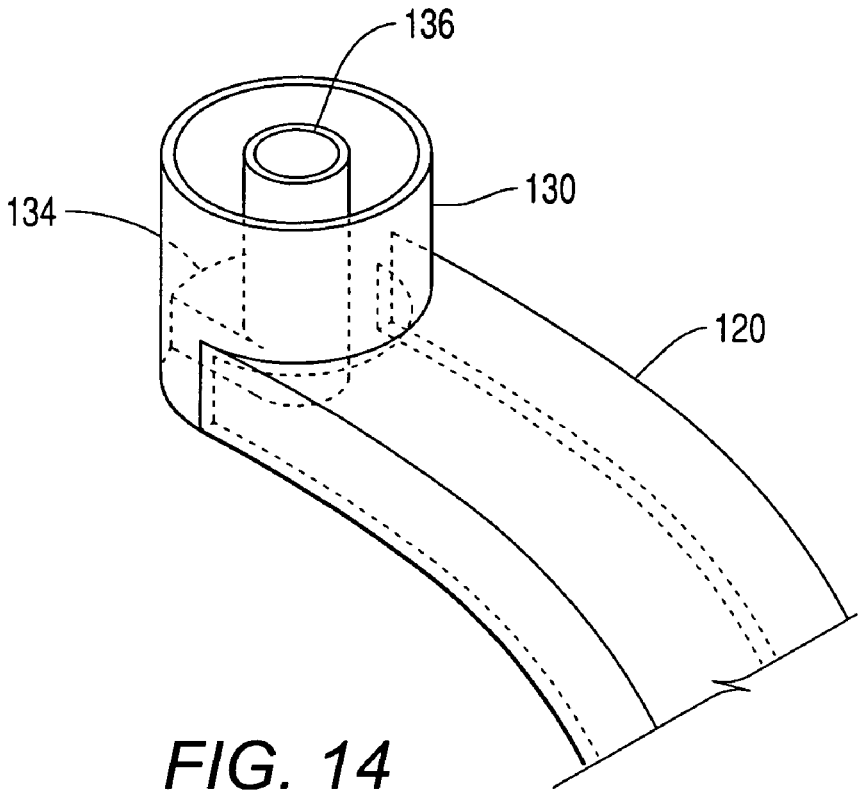
FIGS. 14-15 are perspective views showing air passage ways within the connection port of FIG. 12.
Figure 15:
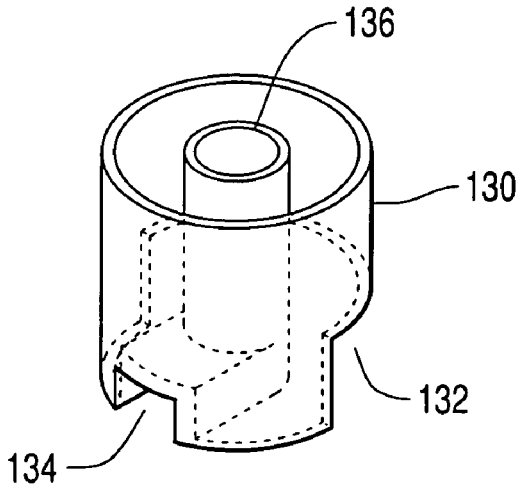

It is possible for the connection port 130 to be integrated into the manifold assembly 100 as shown in FIG. 12. It is also possible to have the connection port integrated into the intake 120 as shown in FIG. 14, or a standalone connection port 130 as shown in FIG. 15. The pieces could then be assembled and fixed in place by conventional methods.

With this arrangement, because of the symmetry of the hose, orientation of the connection hose is not critical. Thus, there is no need for keying. This may enable quicker coupling and decoupling of the connection hose 140 from the manifold assembly connection port 130. As with the other embodiment, the connection port and hoses should be sized to flow a suitable volume of air.

Figure 16:
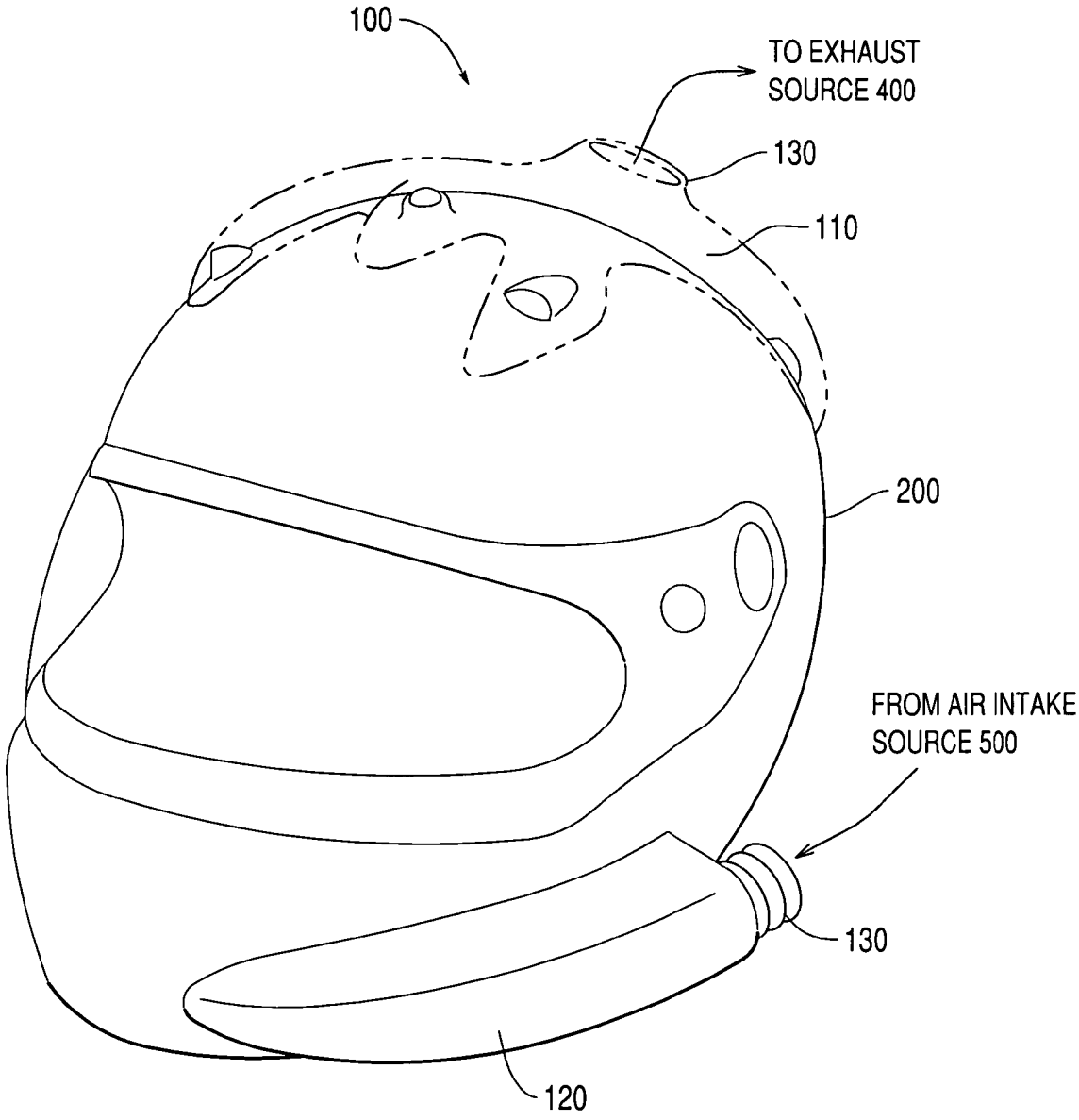
FIG. 16 is a perspective view of an exemplary helmet and forced air circulation system according to another embodiment.

An alternative embodiment of a forced air circulation system and helmet is shown in FIG. 16. In this embodiment, separate intake and exhaust assemblies 120 and 110, respectively, are provided. Each assembly also includes its own connection port 130. In this example, because separate ports are used, a standard single tube connection hose can be provided defining a single flow duct. The intake assembly 120 may take the form of a standard side-mount port, such as used in the Arai GP-5Kac and GP-5ac helmets, which provides an air inlet into the mouth region of the helmet through an opening in the shell 120. However, the shell 210 is modified to include apertures 215 and receives an exhaust manifold assembly 110 similar to that in previous embodiments, but with no opening in the connection port that communicates with the intake assembly 120. In this example, two connection hoses are needed that are each separately connected to one of sources 400, 500. As with the prior embodiments, this embodiment results in complete circulation of air into the mouth region and exhausted out of the crown region in a balanced manner.

Figure 17:
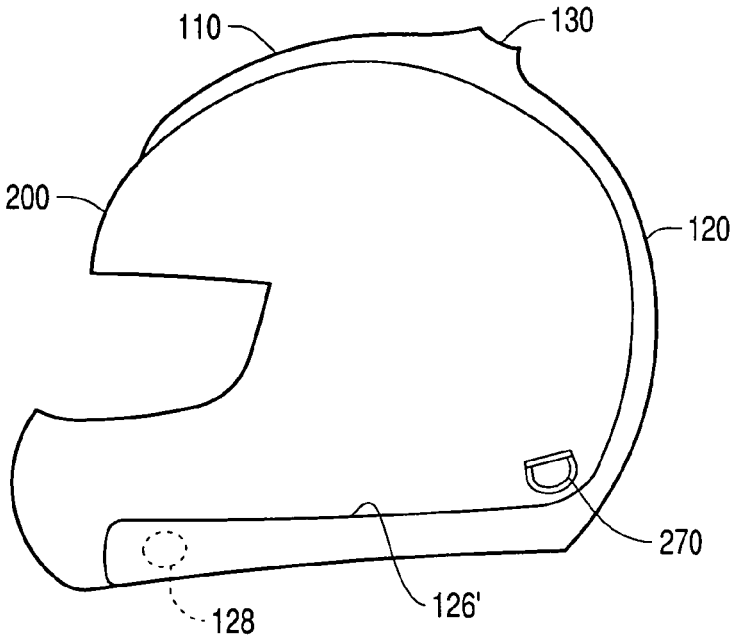
FIG. 17 is a side view of an exemplary protective helmet and forced air circulation system according to another embodiment.
Figure 18:
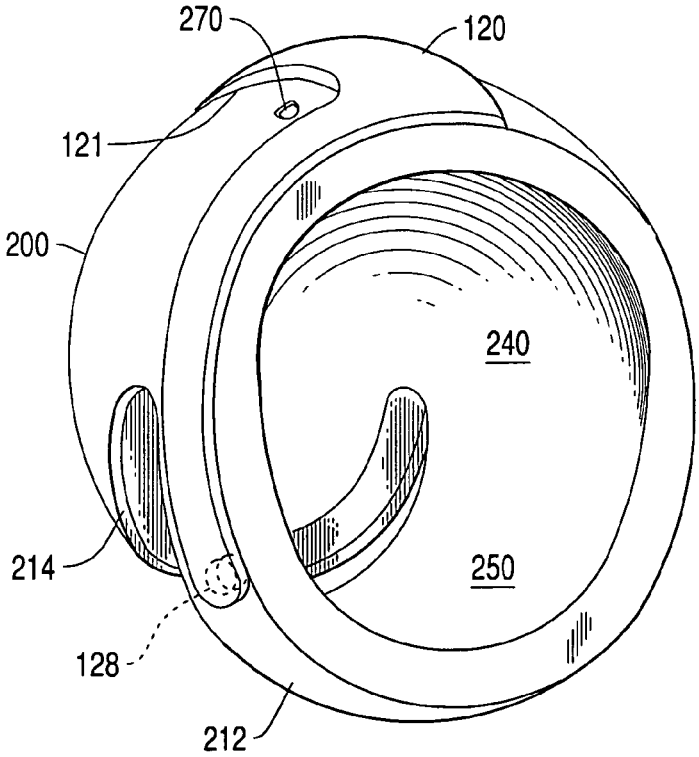
FIG. 18 is a bottom perspective view of the helmet and forced air circulation system of FIG. 17.

Yet another embodiment of a forced air circulation system and helmet is shown in FIGS. 17-18. In this embodiment, exhaust assembly 110 is like the first embodiment. However, intake assembly 120 is L-shaped. In particular, intake assembly 120 extends down the rear side of the helmet as in the first embodiment. Rather than mating with coupler 125, the intake curves near the bottom of the helmet and includes a laterally extending intake 126' that is associated with at least one opening 128 into the helmet. This is similar to that of a side mount port that provides an air inlet into the bottom region 250 of the helmet through an opening in the shell 120. However, because a separate side connection port is not needed on the side for the intake air as in the FIG. 16 embodiment, the intake 126' can have a very thin profile. This thin side profile intake 126' can be located so as to not interfere with restraint system attachment points 270 on the helmet by having the intake curve under or over the attachment point. That is, the location of the attachment point or the location of the intake can be moved slightly to accommodate use of both systems. This allows the helmet to be used without interfering with a helmet restraint system. Also, because there is no connection hose on the side as in FIG. 16, the top-mounted hose 140 will not interfere with the restraint system or seat. Moreover, this embodiment does not require any of the assembly to extend below the helmet as in the first embodiment. Although not shown, it is possible to have intake 126' provided on one or both sides of the helmet. As with the prior embodiments, this embodiment results in complete circulation of air into the bottom region near a mouth and nose of the wearer and exhausted out of the crown region in a balanced manner.

All of the above embodiments are particularly suited for use in automotive racing in an enclosed vehicle cockpit, where a fresh supply of clean and cool air is needed and ventilation is often poor. In such environments, the sources 400, 500 can be fixedly mounted to the vehicle. A wearer having the helmet-mounted portion of the air circulation system installed on the helmet may readily connect to the sources 400, 500 through simple and quick attachment of fitting 160 of connection hose(s) 140 with the connection port on the helmet. Similarly, decoupling of system components can be simply achieved by removal of the hose fitting from the helmet.

In many forms of racing, minimizing vehicle time in the pits and minimizing occupant exit times in case of an emergency are critical. Particularly in the described single connection port embodiments, a driver, occupant or crew can readily couple or decouple the helmet from the remainder of the air circulation system with a simple movement of one hose fitting. Also, in embodiments where the single connection port is provided on top of the helmet, the connection port is readily accessible to the driver or crew and does not interfere with the seat supports or helmet restraint systems used by many drivers. As a result, a driver can be provided with the comfort of fresh and cool air, without suffering a penalty in inconvenience.

It will be appreciated that various of the above-disclosed and other features and functions, or alternatives thereof, may be desirably combined into many other different systems or applications. Also, various presently unforeseen or unanticipated alternatives, modifications, variations or improvements may be subsequently made by those skilled in the art, and are also intended to be encompassed by the claims.

What is claimed is:

1. A protective helmet connectable to a forced air circulation system, comprising a full face protective shell meeting at least minimum industry standard safety reciuirements for impact protection, the protective shell having an interior and exterior surface, the interior surface defining an interior crown region sized to fit a wearer's head and a bottom air space region of the protective shell, in close proximity with a wearer's mouth, defined by a protective chin piece extending over a wearer's mouth;

an external manifold assembly mounted to the external surface of the protective shell, the external manifold defining an exhaust passage external of the shell and in fluid communication with the interior crown region of the shell, an intake passage external of the shell and in fluid communication with the bottom air space region of the shell, and at least one connection port;

a removable intake duct connectable to a remote positive pressure source at one end and connected to the intake passage on the other end through the at least one connection port;

a removable exhaust duct connectable to a remote source of negative pressure at one end and connected to the exhaust passage of the external manifold on the other end through the at least one connection port, wherein fresh air is circulated first to a wearer's mouth at the bottom region by the positive pressure source and exhaust air is forcefully removed from the crown region by the negative pressure source to provide a complementary air circulation system for the wearer of the helmet.

2. The protective helmet according to claim 1, wherein the external manifold has a single connection port that connects to both the exhaust passage and the intake passage.

3. The protective helmet according to claim 2, wherein a divider wall divides the connection port into separated intake and exhaust chambers.

4. The protective helmet according to claim 1, wherein the shell includes one or more apertures in the crown region that are in fluid communication with the exhaust passage.

5. The protective helmet according to claim 4, wherein five spaced apertures are provided around the crown region to cover both fore and aft portions of a wearer's head.

6. The protective helmet according to claim 4, wherein the apertures are sized less than 13 mm in diameter.

7. The protective helmet according to claim 1, wherein the manifold is mounted at a crown of the shell and the intake passage extends along a rear external periphery of the shell and around a portion of a bottom periphery of the helmet.

8. The protective helmet according to claim 7, wherein the intake passage includes one or more openings that open into the bottom region of the helmet.

9. The protective helmet according to claim 8, wherein the openings are provided only into the bottom air space region of the helmet.

10. An air circulation system fittable to a protective helmet, comprising:

an external manifold mountable to an external surface of a full face protective shell of a helmet meeting at least minimum industry standard safety requirements for impact protection, the external manifold defining an exhaust passage external of the shell having at least one orifice communicable with an interior crown region of the shell and an intake passage external of the shell communicable with an interior bottom region of the shell defined by a protective chin piece of the shell that extends over and in close proximity with a wearer's mouth;

a removable intake duct connected to a positive pressure source at one end and connected to the intake passage on the other end; and a removable exhaust duct connected to a source of negative pressure at one end and connected to the exhaust passage of the external manifold on the other end, wherein fresh air can be circulated first to the wearer's mouth at the bottom region of the protective shell by the positive pressure source and exhaust air can be forcefully removed from the crown region by the negative pressure source to provide a complementary air circulation system for the wearer of the helmet.

11. The air circulation system according to claim 10, wherein the external manifold has a single connection port that connects to both the exhaust passage and the intake passage.

12. The air circulation system according to claim 11, wherein a divider wall divides the connection port into separated intake and exhaust chambers.

13. The air circulation system according to claim 10, wherein the removable intake duct and the removable exhaust duct are formed by two hoses, one provided within the other, commonly attached to a single fitting matable with the connection port.

14. The air circulation system according to claim 10, wherein the source of positive pressure is a blower motor.

15. The air circulation system according to claim 10, wherein the source of negative pressure is a blower motor.

16. The air circulation system according to claim 10, wherein the source of negative pressure is a non-powered source.

17. The air circulation system according to claim 16, wherein the non-powered source is a NACA duct.

18. The air circulation system according to claim 10, wherein the manifold is mountable at a crown of the shell and the intake passage extends along a rear external periphery of the shell and around at least a portion of a bottom periphery of the shell exiting through at least one opening adjacent the bottom region of the helmet.

19. The air circulation system according to claim 18, wherein openings are provided only into the bottom air region of the helmet.

20. An air circulation system fittable to a protective helmet, comprising:

an external manifold mountable to an external surface of a protective shell of a helmet meeting at least minimum industry standard safety requirements for impact protection, the external manifold defining an exhaust passage external of the shell having at least one orifice communicable with an interior crown region of the shell and an intake passage external of the shell in communication with an interior bottom region of the shell defined by a protective chin piece of the shell that extends over and in close proximity with a wearer's mouth, the external manifold defining a single connection port;

a coaxial air circulation duct connectable to the single connection port of the external manifold, the coaxial air circulation duct defining a first separate flow channel connected to a positive pressure source at one end and connected to the intake passage on the other end and a second separate flow channel connected to a source of negative pressure at one end and connected to the exhaust passage of the external manifold on the other end, wherein fresh air can be circulated first to the wearer's mouth at the bottom region of the shell by the positive pressure source and exhaust air can be forcefully removed from the crown region by the negative pressure source to provide a complementary air circulation system for the wearer of the helmet.

* * * * *